United States Patent [19]

Hoehn et al.

[11] Patent Number: 4,657,225

[45] Date of Patent: Apr. 14, 1987

[54] PORTABLE SELF-CONTAINED INTRUSION DEVICE

[76] Inventors: Frederick C. Hoehn, 261 Brehaut Ave., Staten Island, N.Y. 10307; George Toth, 874 E. 14th St., Brooklyn, N.Y. 11230

[21] Appl. No.: 887,873

[22] Filed: Jul. 21, 1986

[51] Int. Cl.[4] ..... B66F 3/24

[52] U.S. Cl. ..... 254/93 HP; 254/100; 254/104; 29/239; 72/705

[58] Field of Search ..... 254/100, 104, 93 HP; 72/705; 29/239

[56] References Cited

U.S. PATENT DOCUMENTS

| | | | |
|---|---|---|---|
| 1,483,831 | 2/1924 | O'Brien | 29/239 |
| 1,808,625 | 6/1931 | Barnhart | 29/239 |
| 1,878,624 | 9/1932 | Estes | 29/239 |
| 1,988,840 | 1/1935 | Harth | 254/104 |
| 2,696,359 | 12/1954 | Hill | 254/100 |
| 3,325,095 | 6/1967 | Mueller et al. | 254/100 |
| 3,822,861 | 7/1974 | Scott | 254/104 |
| 4,273,311 | 6/1981 | Rio | 72/705 |

*Primary Examiner*—Robert C. Watson

[57] ABSTRACT

The present invention is directed to a new and improved design associated with the fabrication and construction of a portable self-contained intrusion device that utilizes in conjunction therewith prior art technology of expandable air bags wherein there is provided a hollow static bar member having rotatably affixed thereto a threaded collar member which is capable of receiving a threaded pressure bar member such that upon rotational movement of the threaded collar member, the pressure bar member is either extended from or retracted into the hollow static bar member thereby causing the selective positioning of the portable self-contained intrusion device across any inwardly opening door. By having wedge members affixed to to exposed ends of the static bar member and the pressure bar member respectively, there is achieved a stable method to quickly and silently place across an inwardly opening door the portable self-contained intrusion device. By having a pressure plate that is capable of being selectively aligned between the hollow static bar member and the door to be forceably opened and which is capable of having positioned between itself and the door in question an expandable air bag, a method is achieved for gaining quick forceable access to an entryway as is required in many situations associated with police activity.

2 Claims, 3 Drawing Figures

PORTABLE SELF-CONTAINED INTRUSION DEVICE

BACKGROUND AND OBJECTS OF THE INVENTION

The present invention relates to a generally new and improved design associated with the fabrication and construction of a portable self-contained intrusion device capable of providing a means to obtain quick forceable entry through any inwardly opening door as is necessary on many occasions related to police activity.

In conjunction therewith and prior to the present invention, intrusion devices for gaining access through barred doors were known, but not of a design nor method of construction which lent themselves to the advantages and overall efficiencies achievable in conjunction with the present invention.

Although it was known in the prior art to construct various types of mechanisms capable of providing a stable platform or providing support pedestals, none of said prior art devices directed themself to the present invention and its specific design and manner of operation nor achieved its advantages.

With regard to the prior art referred to above, attention is herein drawn to the following United States patents, same being representative of the state of the prior art to date, but none of them either individually nor in combination teach or otherwise disclose the present invention, said prior art being as follows, to wit: U.S. Pat. No. 2,696,359 issued on Dec. 7, 1954, issued to J. M. Hill; U.S. Pat. No. 1,723,970 issued on Aug. 6, 1929, issued to R. J. Jauch; U.S. Pat. No. 1,632,422 issued on June 14, 1927, issued to H. H. Strait; U.S. Pat. No. 617,163 issued on Jan. 3, 1899, issued to D. Jacobs; U.S. Pat. No. 132,922 issued on Nov. 12, 1872, issued to G. B. Pharo; U.S. Pat. No. 468,463 issued to Feb. 9, 1892, issued to W. Ludwig; U.S. Pat. No. 2,865,585 issued on Dec. 23, 1958, issued to T. W. Beyer et al; International patent publication number WO 79/00022 issued to William Osborn Holmes and given International publication dated Jan. 25, 1979.

In the context of the above, it is one of the primary objectives of the present invention to create a new and improved portable self-contained intrusion device that is capable of being readily affixed across an obstructed inwardly opening door so that entrance there through can be achieved in a minimal amount of time and with a minimum amount of noise generated with regard to the placing of said device across said door opening.

It is another object of this invention to create a new and improved portable self-contained intrusion device wherein said device is capable of receiving between itself and the door to be forceably opened a pressure bag capable of selective actuation such that the pressure exerted by said bag is directed selectively against the door.

It is another object of this invention to create a new and improved portable self-contained intrusion device wherein upon causing said door to be opened through the exertion of pressure from said pressure bag, said portable self-contained intrusion device is capable of automatically falling from its initial placement across said opening thereby providing instant access through said opening.

It is another object of this invention to create a new and improved portable self-contained intrusion device wherein said device is constructed in a fashion so as to sustain repeated and continued utilization without requiring repair or maintenance.

The objects and advantages of the invention are set forth in part herein and in part will be obvious herefrom or may be learned by the practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved design associated with the fabrication and construction of a portable self-contained intrusion device wherein a hollow static bar member has rotatably affixed about one end thereof an internally threaded collar member. Mechanically interfitted with said internally threaded collar member is a threaded pressure bar member that is threaded about its external surface and capable of mechanical interfit with said internally threaded collar member by the interrelationship between the internal threading of said internally threaded collar member and the external threading appearing on the surface of said threaded pressure bar member.

Upon rotational movement of said internally threaded collar member, the threaded pressure bar member is either mechanically moved into the hollow portion of said hollow static bar member or out from the interior hollow portion of said static bar member depending upon the rotational direction applied to said internally threaded collar member. In this fashion there is achieved the ability to mechanically extend or retract the overall dimensions of the combination of said hollow static bar member with said threaded pressure bar member. By having the axis of threaded pressure bar member be in direct alignment with the axis of said hollow static bar member, there is achieved a portable self-contained intrusion device whose overall length can be selectively adjusted.

Affixed to the exposed exterior end of said hollow static bar member is a wedge member constructed so as to provide the capability of having same fit between the surface of the door in question and the door jam thereof as the device is positioned across the doorway in question. In this manner the device is held in place due to the forcing of the surface of the door in question back from its door jam and not by having said wedge member penetrate the surface of said door jam. A spacing inherent in the design of the device is created between the face portion of said wedge member that comes into contact with the door to be opened and the exterior portion of said hollow static bar member so as to provide room for the positioning of a pressure plate and an air bag between said device and the surface of said door in question.

Similarly, a second wedge member is mechanically affixed to the exposed end of said threaded pressure bar member such that said second wedge member is also capable of fitting between the surface of the door in question and the door jam thereof as the device is positioned across the doorway in question. As similarly stated with regard to said first wedge member, said second wedge member and thus said portable self-contained intrusion device is held in place due to the forcing of the surface of the door in question back from its door jam which in turn causes a responding compressive force to be exerted against said respective wedge members thereby causing said device to be held in position across said door opening, said placement not occurring as a result of having said wedge members respectively penetrate the respective surfaces of said door jam. Furthermore, as is inherent in the design of the device, the face portion of said second wedge member that comes into contact with the surface of the door to be opened is also of a sufficient distance from the exterior portion of said threaded pressure bar member so as to provide a uniform spacing throughout the entry length of said portable self-contained intrusion device and the surface of said door when viewed in combination with the overall device.

In this fashion, there is provided sufficient spacing between said portable self-contained intrusion device and the exterior surface of the door to be opened so as to allow for the placement of a pressure plate there between, as well as to allow sufficient space to exist for the further placement between the door to be opened and the face surface of said pressure plate of an expandable air bag.

Due to the construction of said pressure plate and its mechanical interfit with said hollow static bar member, there is achieved the ability to have the full force of the expandable air bag applied at a particular location on the surface of said door that is to be forceably opened without concern that said force would cause the dislodging of said portable self-contained intrusion device from its initial positioning across said doorway.

Since said wedge members are positioned between the door itself and the door jam and in effect force the door inward somewhat upon the positoning of said device across a door opening, there is achieved upon the blowing open of said doorway the automatic dropping to the ground of said portable self-contained intrusion device from across the doorway opening itself once said door is blown open, thus providing immediate access through the doorway opening so as to enable police or other personnel to achieve immediate access through same.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

DESCRIPTION OF A PREFERRED EMBODIMENT

Figure 1:
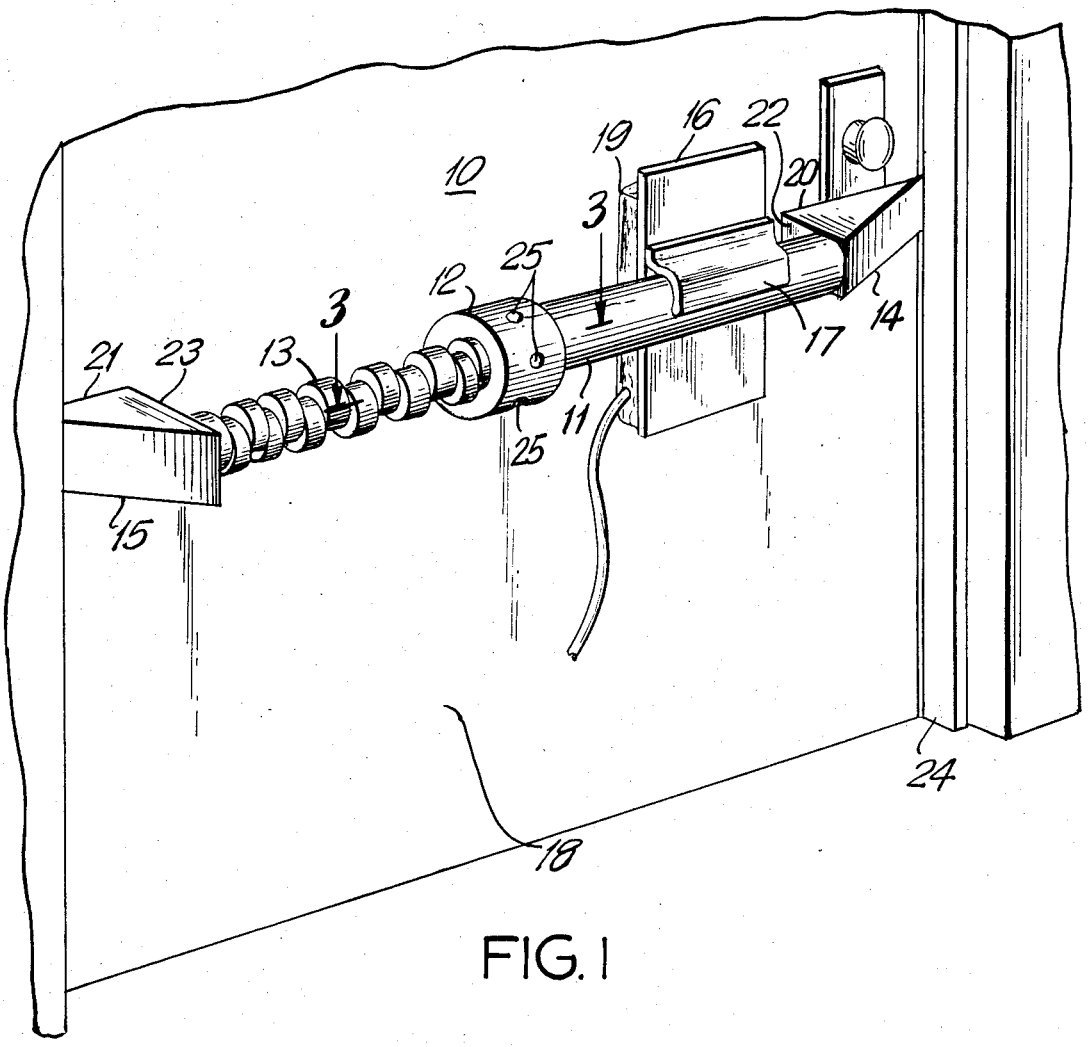
FIG. 1 is a three dimensional prospective view of a portable self-contained intrusion device constructed in accordance with the invention evidencing its placement across the door opening of an inwardly opening door wherein said door is closed.
Figure 2:
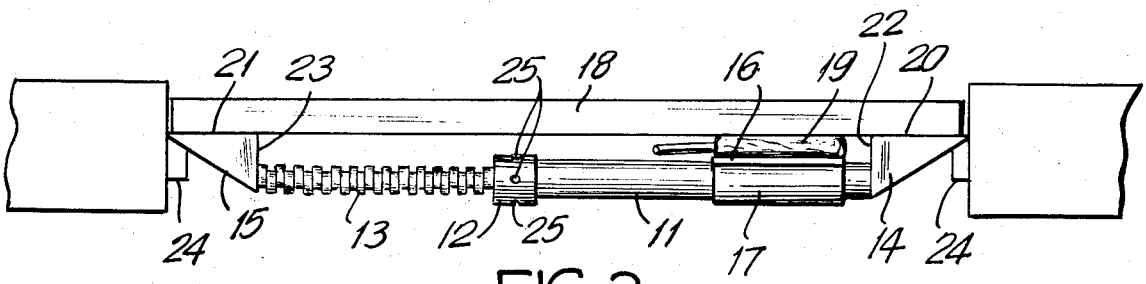
FIG. 2 is a top elevational view of a portable self-contained intrusion device constructed in accordance with the invention as depicted in FIG. 1 depicting its placement across the door opening of an inwardly opening door.

Referring now more particularly to the embodiment of the above invention illustrated in the accompanying drawings, there is illustrated in FIG. 1 and FIG. 2 a portable self-contained intrusion device constructed in accordance with the instant invention and indicated generally by reference numeral 10.

Figure 3:
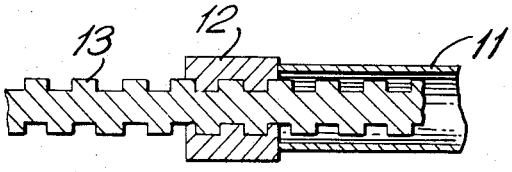
FIG. 3 is a partial cross-sectional view of the portable self-contained intrusion device constructed in accordance with the invention as depicted in FIG. 1 and taken along line 3—3 of FIG. 1.

In accordance with the invention, and as illustrated in FIG. 1, FIG. 2 and FIG. 3, portable self-contained intrusion device 10 consists of the following interrelated components, to wit, a hollow static bar member 11 being of a cylindrical design and having mechanically interfitted with it, at one of its exposed ends, internally threaded collar member 12, the axis of both being in alignment with each other. Internally threaded collar member 12 is capable of rotational movement about its axis even though mechanically aligned with hollow static bar member 11. Threaded pressure bar member 13 is also in axle alignment with internally threaded collar member 12 and hollow static bar member 11, there being formed about the exterior surface of threaded pressure bar member 13, external threads which are mechanically interfitted with the internal threading of internally threaded collar member 12 such that upon the rotational movement of internally threaded collar member 12 about its axis, threaded pressure bar member 13 is caused to move parallel to its axis either into hollow static bar member 11 or outwardly therefrom, depending upon which direction internally threaded collar member 12 is rotated about its axis.

In furtherance of the invention, internally threaded collar member 12 has formed symmetrically about its exterior surface indents 25, same providing the ability to have inserted therein a lever so as to provide the operator of said portable self-contained intrusion device 10 leverage in rotating internally threaded collar member 12.

Mechanically affixed to the end of hollow static bar member 11 which is not in mechanical interfit with internally threaded collar member 12 is wedge member 14 which is triangular in shape. Additionally, mechanically affixed to the end of threaded pressure bar member 13 which is not in mechanical interfit with internally threaded collar member 12 is wedge member 15 which is also triangular in shape, wedge members 14 and 15 being identical in design.

In conjunction with wedge members 14 and 15, it should be noted that they are triangular in shape, and face portion 20 of wedge member 14, as well as face portion 21 of wedge member 15, in the utilization of portable self-contained intrusion device 10, come into direct contact with the outer surface of door 18, which is the doorway through which access entry is sought.

It should be further noted that in keeping with the invention, the affixing of hollow static bar member 11 to wedge member 14 as well as the affixing of threaded pressure bar member 13 to wedge member 15 at said wedge members respective face portions 22 and 23 respectively is such that a sufficient spacing results between the face surface of door 18 and the exterior surface of hollow static bar member 11, same being sufficient so as to permit the placement of pressure plate 16 between the exterior surface of door 18 the exterior surface of hollow static bar member 11, as well as additionally providing sufficient space for the additional placement of air bag 19 between the face surface of pressure plate 16 and the exterior surface of door 18.

As depicted in FIG. 1 and FIG. 2, pressure plate 16 has angular member 17 affixed to the back face of pressure plate 16, angular member 17 being capable of mechanical interfit with the exterior surface of hollow static bar member 11 so as to provide the capability of the placement of pressure plate 16 upon hollow static bar 11 in accordance with the illustration of the device as depicted in FIG. 1 as well as allowing for the selective placement of pressure plate 16 along any desired portion of hollow static bar member 11, thereby being able to selectively position air bag 19 and the point at which the pressure therefrom will be exerted against the external surface of door 18. In this fashion, the point at which pressure is to be applied against door 18 is variable depending upon each particular set of circumstances encountered, thereby achieving accessibility through barred doors.

In conjunction with air bag 19, it should be noted that this is an item well-known in the prior art, one example thereof being manufactured by a company known as Partech, Inc., whose air bag is known in the industry by its trademarked name, to wit: "MAXIFORCE AIR BAG," these prior art air bags operate by having injected into the collapsed bag structure, compressed air from a compressed air source, be it a portable compressed air bottle or other means, and upon the instantaneous release of compressed air into said air bag, said bag inflates, and depending upon the various models, specifications, and construction criteria thereof, there is achieved the ability to cause the exertion by said air bag of pressures against a particular surface of from between 12,000 lbs. per square inch up to approximately 42,000 lbs. per square inch. Said prior air bags, in so doing, change their shape from a thickness of less than one half inch when uninflated to up to approximately five inches when inflated.

As utilized in accordance with the present invention, said air bag is placed between pressure plate 16 and the exterior surface of door 18 as illustrated in FIG. 1 and FIG. 2 in an uninflated state after portable self-contained intrusion device 10 has been placed across the exterior doorway at the particular height off the ground desired as related to the characteristics encountered at a particular door location. Additionally, the placement of pressure plate 16 along hollow static bar member 11 is also selected based upon said characteristics encountered at a particular door location, these above referenced adjustments being done to insure the exertion of the force of air bag 19 at the most vulnerable location on the surface of door 18 so as to achieve access there through.

Upon the release of compressed air into air bag 19, said air bag almost instantly inflates exerting thousands of pounds of air pressure per square inch upon the surface of door 18 opposite air bag 19, and as a result, causes said door to be blown inward from its locked or otherwise barred state thereby rendering immediate access through said doorway.

As should be obvious, the achieving of such immediate access is essential to many types of police activities where such immediate access is required to a barred entryway.

Furthermore, since portable self-contained intrusion device 10 falls immediately away from its positioning across said doorway once door 18 has in fact been blown in, due to the elimination of the compressive force exerted by door 18 against wedge members 14 and 15 respectively, there is provided an immediate unobstructed pathway through said doorway.

In accordance with the above, and as an example of the operation of portable self-contained intrusion device 10, it should be noted that upon the desire to obtain access to a barred door, portable self-contained intrusion device 10 is placed across the exterior portion of said doorway at the desired height from said floor, by causing internally threaded collar member 12 to be axlely rotated about its axis so as to adjust the portion of threaded pressure bar member 13 that extends outward from internally threaded collar member 12, same being such as to cause wedge members 14 and 15 to be forced between door 18 and door jam 24 of door 18. Because of the construction of portable self-contained intrusion device 10, and being in accordance with the invention, sufficient spacing exists once portable self-contained intrusion device 10 has been so placed across said doorway so as to allow for a positioning of pressure plate 16 between hollow static bar member 11 and the face of door 18, angular member 17 of pressure plate 16 being utilized to selectively and mechanically affix pressure plate 16 along hollow static bar member 11 at a desired location between the face of door 18 and the exterior portion of hollow static bar member 11. Once pressure plate 16 has been so positioned, air bag 19 is then placed between the face surface of pressure plate 16 and the exterior surface of door 18 as illustrated in FIG. 1 and FIG. 2 in a manner so as to await the inflating of said air bag upon a predetermined command.

It should be obvious that the utilization of portable self-contained intrusion device 10 provides law enforcement authorities with a readily usable device for gaining entry to barred doors which is portable, quickly set into place, is silently assembled across a particular doorway so as not to cause detection prior to the blowing open of said door, and which upon the blowing open of said door, readily falls away from its positioning across said doorway so as to provide unobstructed immediate access to said doorway.

The preceding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. A portable self-contained intrusion device capable of dislodging a door from a mechanically locked and/or barred position comprising:

(a) a cylindrical threaded pressure bar member;

(b) an internally threaded cylindrical collar member capable of mechanical interfit with said cylindrical threaded pressure bar member so as to enable threaded engagement there between, said internally threaded cylindrical collar member being mechanically threaded about one end of said threaded pressure bar member so as to have a portion of said cylindrical threaded pressure bar member extend beyond the structure of said internally threaded cylindrical collar member, the axis of said internally threaded cylindrical collar member being coincident with the axis of said cylindrical threaded pressure bar member;

(c) a cylindrical hollow static bar member whose axis is aligned with and otherwise coincident with the axis of said internally threaded cylindrical collar member and the axis of said cylindrical threaded pressure bar member, said cylindrical hollow static bar member having an exterior diameter less than the exterior diameter of said internally threaded cylindrical collar member while the internal diameter of the hollow cylindrical opening defined by said cylindrical hollow static bar member is sufficient to allow for the insertion therein of said cylindrical threaded pressure bar member while providing a mechanical interfit there between so as to provide for axial rigidity over the combined lengths of said cylindrical hollow static bar member and said cylindrical threaded pressure bar member, one end of said cylindrical hollow static bar member thereby abutting immediately adjacent to the exterior wall of said internally threaded cylindrical collar member;

(d) a first wedge member defining a right triangular shape so as to have surfaces relative to the height, base and hypotenuse of said right triangular shape, the base surface of said first wedge member being mechanically affixed to the end of said cylindrical threaded pressure bar member such that a spacing is defined between the base surface of said first wedge member as said based surface of said first wedge member is placed adjacent the surface of said door that is to be dislodged from its mechanically locked and/or barred position and the exterior surface of said cylindrical hollow static bar member;

(e) a second wedge member defining a right triangular shape so as to have surfaces relative to the height, base and hypotenuse of said right triangular shape, the base surface of said first wedge member being mechanically affixed to the end of said cylindrical hollow static bar member such that a spacing is defined between the base surface of said second wedge member as said base surface of said second wedge member is placed adjacent the surface of said door that is to be dislodged from its mechanically locked and/or barred position and the exterior surface of said cylindrical hollow static bar member;

(f) a pressure plate member comprising a planar surface member and an angular member, said angular member being structurally affixed to one face of said planar surface member and capable of selective mechanical coupling with the exterior surface of said cylindrical hollow static bar member along any portion thereof so as to provide for the creation of a uniform spacing between the surface of said door that is to be dislodged from its mechanically locked and/or barred position and the surface of said planar surface member that is opposite to said face of said planar surface member of said pressure plate member that is structurally affixed to said angular member; and (g) means for selectively exerting force simultaneously against the surface of said door that is mechanically locked and/or barred as well as against the surface of said pressure plate member that is adjacent to the surface of said door.

2. A portable self-contained intrusion device capable of dislodging a door from a mechanically locked and/or barrel position as set forth in claim 1 above wherein said means for selectively exerting force simultaneously against the surface of said door that is mechanically locked and/or barred as well as against the surface of said pressure plate member that is adjacent to the surface of said door comprise an air pressure bag capable of being inflated by compressed air.

* * * * *